US012715563B1

(12) United States Patent
Chess

(10) Patent No.: US 12,715,563 B1
(45) Date of Patent: Aug. 25, 2026

(54) DIVING INDICATION FLOAT DEVICE

(71) Applicant: Amos Chess, Oakland Park, FL (US)

(72) Inventor: Amos Chess, Oakland Park, FL (US)

( * ) Notice: Subject to any disclaimer, the term of this patent is extended or adjusted under 35 U.S.C. 154(b) by 0 days.

(21) Appl. No.: 19/458,187

(22) Filed: Jan. 23, 2026

(51) Int. Cl.
*B63C 11/26* (2006.01)

(52) U.S. Cl.
CPC ..... *B63C 11/26* (2013.01)

(58) Field of Classification Search
CPC .. B63C 11/26; B63C 7/26; B63C 9/24; G08B 5/002; B63B 2201/08; B63B 2201/12; B63B 2201/14
USPC ..... 116/26, 210, 116; 340/984; 441/7, 11
See application file for complete search history.

(56) References Cited

U.S. PATENT DOCUMENTS 3,171,128 A * 2/1965 Shattuck ..... H01Q 1/1292 343/709
5,163,858 A * 11/1992 Sumrall ..... B63C 7/26 441/13
5,231,952 A * 8/1993 Tenniswood ..... B65H 75/40 116/210
5,403,219 A * 4/1995 Ryan ..... B63B 22/00 441/89
6,463,800 B2 * 10/2002 Fowler ..... B63B 22/24 441/27
7,303,453 B1 * 12/2007 Bourke ..... B63B 22/22 441/6
8,794,475 B1 * 8/2014 Daniels ..... A01K 77/00 220/560
2008/0085643 A1 * 4/2008 Nicholson ..... B63B 22/04 441/6
2015/0348452 A1 * 12/2015 Bendremer ..... G08B 5/002 40/606.01
2015/0353170 A1 * 12/2015 Greenfield ..... B63C 11/26 441/11
2015/0372391 A1 * 12/2015 Sylvia ..... B63B 22/22 342/10

FOREIGN PATENT DOCUMENTS

JP 3239149 U * 9/2022

OTHER PUBLICATIONS

Translation of Description JP3239149U (Year: 2022).*

* cited by examiner

*Primary Examiner* — Kristina M Deherrera
*Assistant Examiner* — Evan Mancini
(74) *Attorney, Agent, or Firm* — The Concept Law Group, PA; Scott D. Smiley; Scott M. Garrett

(57) ABSTRACT

A diving indication float device includes a buoyant body configured to float on a water surface and a vertical shaft extending upward therefrom. An inflatable flag portion comprises a balloon displaying a diver down symbol, preferably with a lighter-than-air gas for enhanced visibility. A cord attached to the flag portion allows adjustable height extension beyond the shaft's distal end. Optional features include a reel for cord management, a stabilizing weight, a light element for illumination, reflective materials, a telescoping flag rod for an alternative two-dimensional flag, a compression nut assembly for securing the balloon or rod, and a clamp for attachment to external structures like paddle boards or boats. The device enhances diver safety by providing conspicuous signaling in various conditions.

8 Claims, 14 Drawing Sheets

DIVING INDICATION FLOAT DEVICE

FIELD OF THE INVENTION

The present invention relates generally to a float device for use in the water to indicate that people are diving in the water nearby, and, more particularly, relates to float device that includes an inflatable element on which the universal "diver down" symbol is indicated and that is tethered to an rigid vertical member that extends upward from the floating body.

BACKGROUND OF THE INVENTION

Diving and snorkeling a common recreational activities in marine and other aquatic environments. As a result, there is often boat traffic around areas that a popular diving and snorkeling locations. It is obviously dangerous to have boats operating around people who are in the water, diving and snorkeling due to the difficulty in seeing people in the water and the chance of a person coming to the surface in the path of a boat. To mitigate the chance of injury, dive flags are used to warn boaters that there are people in the water, and in many places, boaters are required to keep away from the location of a raised dive flag by at least some minimum distance. The dive flag is universally recognized as a generally red square or rectangle with a diagonal white stripe. A dive flag can be deployed on a boat to indicate that there are people in the water near the boat. It is also common for the divers/snorkelers to have a diving indication float device in the water with them, that they tow as they swim and dive. The diving indication float device includes a buoyant portion in which there is a stick or rod mounted that is often several feet long. At the end of the stick there is a flat dive flag, often made of a polymeric material, and including a wire stiffener to prevent the flag from collapsing in low wind conditions.

One problem with conventional dive flags is that they are flat, and if a boater approaches from directly upwind or downwind directions, they may not see the dive flag because they will be looking at the edge of a flat article (the flag). Another problem is that, despite minimum height being standardized for the position of the flag relative to the float body, this still may not be high enough to be seen in all situations. Further, in low light conditions, the visibility of the dive flag can be reduced.

Therefore, a need exists to overcome the problems with the prior art as discussed above.

SUMMARY OF THE INVENTION

In accordance with some embodiments of the inventive disclosure, there is provided a diving indication float device that includes a float body comprised of a buoyant material, a vertical extension that extends from the float body to a distal end, a balloon having a minimum cross dimension of twelve inches, and a cord that couples the balloon to the distal end of the vertical extension.

In accordance with a further feature, the vertical extension comprises a tube having an internal bore, wherein the cord is routed at least partly through the internal bore.

In accordance with a further feature, there is further included a reel mounted on the vertical extension, wherein the cord is routed through the internal bore to an opening through the vertical extension to the reel.

In accordance with a further feature, the balloon includes a plug to which a body of the balloon is attached, and wherein the cord is attached to the plug.

In accordance with a further feature, a portion of the plug to which the cord is attached is sized to fit into the bore of the vertical extension at the distal end.

In accordance with a further feature, the balloon is filled with a lighter than air gas.

In accordance with a further feature, there is further included a weight at a bottom of the float body, opposite the vertical extension.

In accordance with a further feature, there is further included a light source configured to emit light in a vertical direction along the vertical extension and outward in a horizontal direction.

In accordance with a further feature, the vertical shaft is at least partly covered with a light reflecting material.

In accordance with some embodiments of the inventive disclosure, there is provided a kit for a diving indication float device that includes a buoyant body configured to float on a surface of a body of water, a vertical shaft configured to extend upwards from the buoyant body to a distal end, an inflatable flag portion comprising a balloon that, when inflated, has a minimum cross dimension of at least twelve inches and displays a diver down symbol, a cord configured to attach to the inflatable flag portion and extendable along the vertical shaft to adjust a height of the inflatable flag portion relative to the distal end of the vertical shaft, an extendible flag rod configured for telescoping arrangement with the vertical shaft, a two-dimensional flag configured to attach to an upper end of the extendible flag rod, and a securing mechanism configured to mount at the distal end of the vertical shaft to selectively hold either the inflatable flag portion or the extendible flag rod.

In accordance with a further feature, the securing mechanism is a compression nut assembly comprising a threaded cylindrical body, a resilient cylindrical member with a bore, and a domed nut configured to compress the resilient cylindrical member to narrow the bore.

In accordance with a further feature, the compression nut assembly is configured to seal around a stem of the balloon when holding the inflatable flag portion.

In accordance with a further feature, the balloon is configured to be filled with a gas lighter than air, and the diver down symbol comprises a red background with a diagonal white stripe that encircles the balloon.

In accordance with a further feature, there is further included a reel configured to mount on the vertical shaft or the buoyant body, the reel arranged to wind and unwind the cord.

In accordance with a further feature, there is further included a buoyant body that is configured to be adjustably disposed on the vertical shaft, and clamp that is configured to be attached to the vertical shaft to clamp the vertical shaft to another structure.

In accordance with some embodiments of the inventive disclosure, there is provided a diving indication float device that includes a buoyant body, a vertical shaft extending upwards from the buoyant body, an extendible rod telescopically disposed within the vertical shaft, a flag attached to an upper end of the extendible rod, and a securing mechanism at a distal end of the vertical shaft to hold the extendible rod at a desired extension.

In accordance with a further feature, the securing mechanism is a compression nut assembly.

In accordance with a further feature, there is further included an adjustable ring on a lower portion of the vertical shaft to vary a length below the buoyant body for stability in varying water conditions.

In accordance with a further feature, there is further included a clamp for attaching the device to an external structure.

Although the invention is illustrated and described herein as embodied in a diving indication float device, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down," "left," "right," "inside," "outside," "front," "back," "head," "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first," "second," "third," and so on are only used for descriptive purposes and cannot be construed as indicating or implying relative importance.

In the description of the embodiments of the present invention, it should be noted that, unless otherwise clearly defined and limited, terms such as "installed," "coupled," "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances, these terms may include numbers that are rounded to the nearest significant figure. In this document, the term "longitudinal" should be understood to mean in a direction corresponding to an elongated direction of the article being referenced. Those skilled in the art can understand the specific meanings of the above-mentioned terms in the embodiments of the present invention according to the specific circumstances.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1A:
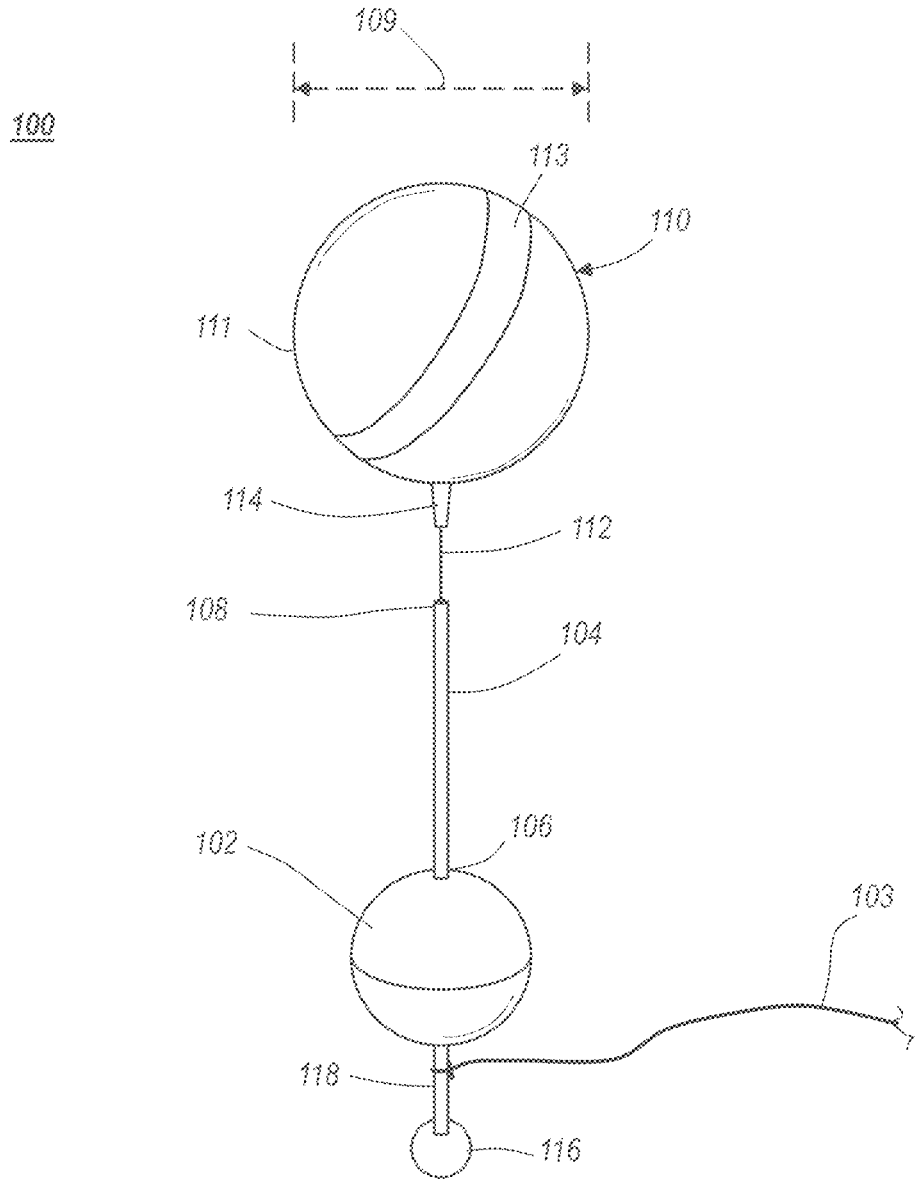
FIG. 1A shows a side view of a diving indication float device, including an inflatable flag portion, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 1B:
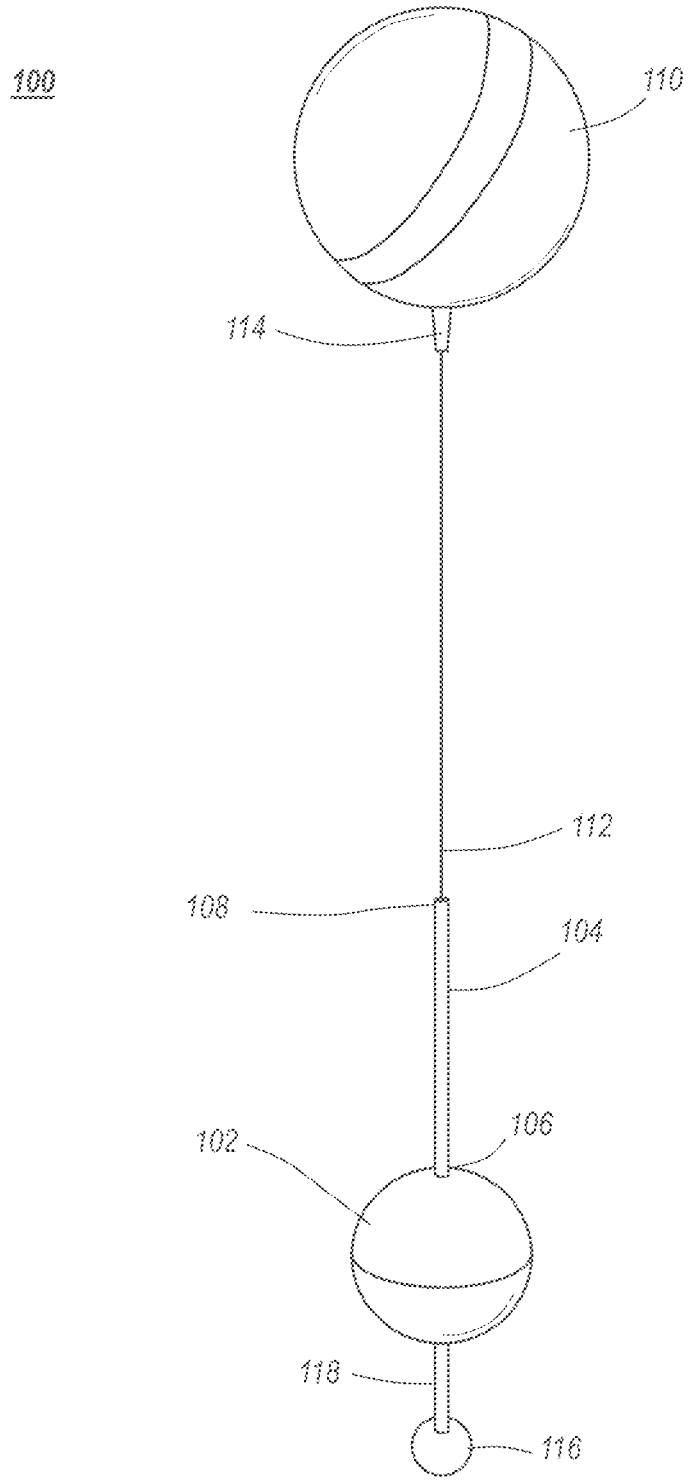
FIG. 1B shows a side view of a diving indication float device, including an inflatable flag portion with the inflatable flag portion allowed to rise, in accordance with some embodiments.
Figure 8:
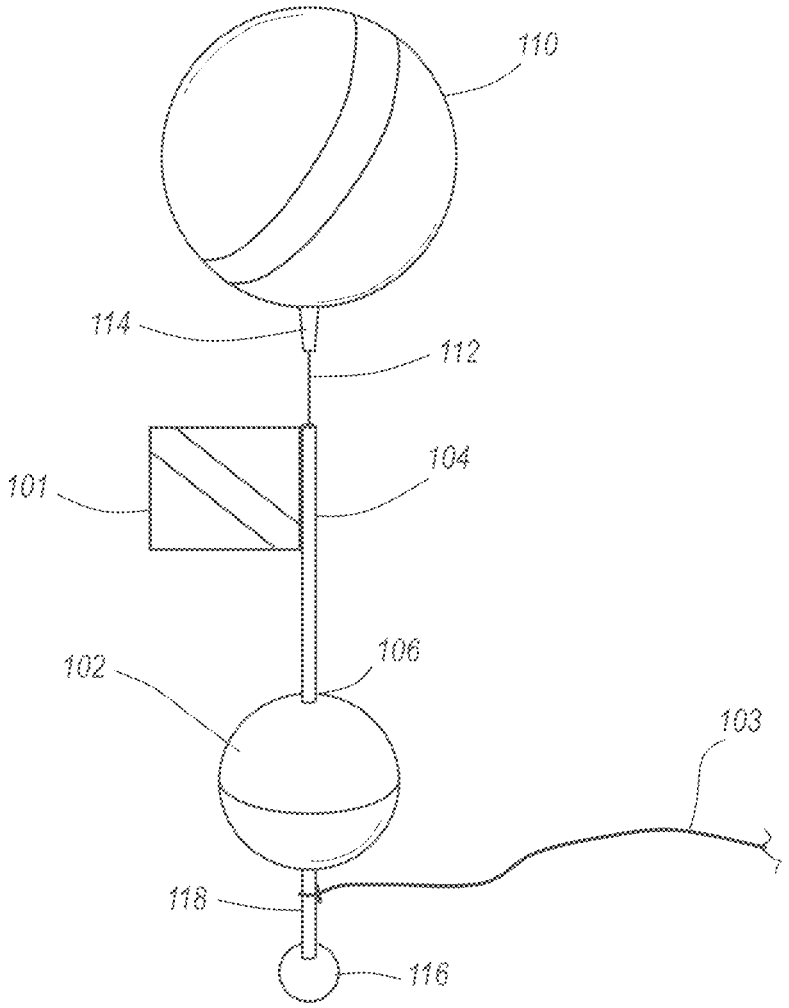
FIG. 8 shows a side view of a diving indication float device, including an inflatable flag portion in addition to a conventional dive flag, in accordance with some embodiments.

FIG. 1A shows a side view of a diving indication float device 100, including an inflatable flag portion 110, in accordance with some embodiments. The device 100 includes a buoyant body 102 that can be, for example, a buoyant foam, or an air-filled or hollow body. The body 102 shown here is spherical, but other shapes are equally useable, including, for example, a floating board-type body. At the top or top side of the body 102 there is a vertical structure in the form of a vertical shaft 104 that extends upwards from a base 106 to a distal end 108. The purpose of the vertical shaft 104 in some embodiments is to provide a minimum elevation of the inflatable flag portion 110 from the body 102. The vertical shaft 104 can be a rod or tube that is rigid, and preferably of minimal weight. In some embodiments the vertical shaft 104 is hollow and other structure can be at least partially housed inside the vertical shaft 104, including in a telescoping relationship. A cord 112 runs along, or through the vertical shaft 104 and is attached to the inflatable flag portion 110. The cord 112 can be extended or withdrawn to raise or lower the inflatable flag portion 110. The cord can be any flexible cord, string, line, chain, or similar cordage, and it is attached to, for example, a collar 114 of the inflatable flag portion 110. The inflatable flag portion 110 includes a balloon 111 made of, for example, mylar film, and is preferable filled with a gas that is lighter than air, such as helium. Being inflatable, the balloon 111, when inflated, takes on a three dimensional shape, which means that it can't be viewed along an edge the way a two dimensional flag can be viewed. To ensure visibility, the balloon 111 can have a minimum cross dimension 109 of at least twelve inches. Although larger is better. The minimum cross dimension refers to the shortest distance from one side of the balloon 111 to the opposite side, in a horizontal direction or in the horizontal plane, when the balloon is properly inflated. Twelve inches is specified for conventional dive flags, so by making the balloon at least twelve inches across, not matter what angle it is viewed, helps ensure it will be seen. The balloon 111 has the "DIVER DOWN" symbol on it, meaning the balloon is generally red all over with a diagonal white stripe 113 in view. The white stripe 113 can encircle the balloon 111, meaning there is one continuous white stripe around the entirety of the balloon 111. To counteract the weight and any wind-resultant force, there can be a weight 116 positioned at the bottom of the body 102, which can include a short post 118 to offset the weight 116 from the body 102, and provide a larger righting moment to keep the vertical shaft 104 upright. A line 103 can be tied to the weight 116 or the post 118 so that the device 100 can be towed by the diver or snorkeler in the water. The post 118 can be the lower portion of the vertical shaft 104. In FIG. 1B the inflatable flag portion 110 is shown deployed farther than in FIG. 1A, by letting out more of the cord 112. The collar 114 of the inflatable flag portion 110 is designed to fit, at least partly, into the top of the distal end 108 of the vertical shaft, when the cord 112 is fully gathered. On windy days, then the inflatable flag portion would be blown to far to the side, the cord 112 can be gathered to mount the inflatable flag portion 110 on the distal end 108 of the vertical shaft. When the wind is not such a factor, then the cord 112 can be let out to allow the inflatable flag portion 110 to rise up further than the distal end 108 of the vertical shaft 104. The vertical shaft 104 should have a height, above the body 102, of about three to four feet. The cord is long enough to allow the inflatable flag portion 110 to rise up another seven to eight feet in some embodiments. It is also contemplated that the inflatable flag portion 110 can be let up even further, and a conventional two dimensional flag 101 can be attached to the top of the vertical shaft, as shown in FIG. 8, for example.

Figure 2:
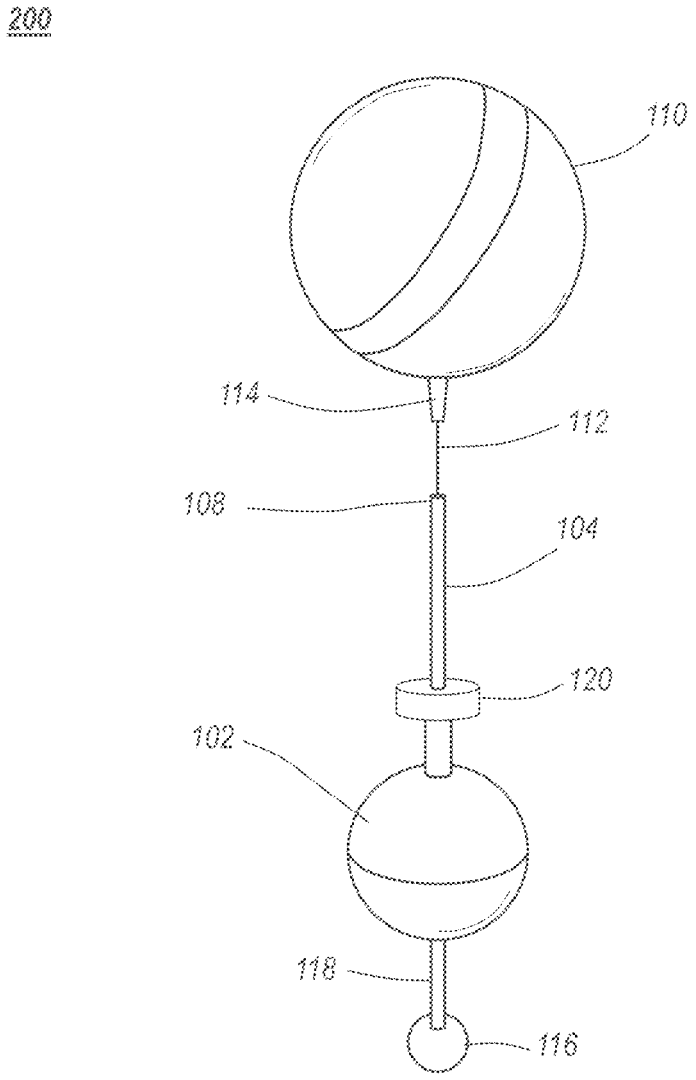
FIG. 2 shows a side view of a diving indication float device, including an inflatable flag portion and including a light element, in accordance with some embodiments.

FIG. 2 shows a side view of a diving indication float device 200, including an inflatable flag portion 110 and including a light element 120, in accordance with some embodiments. The device 200 is otherwise identical to device 100. The light element 120 is a battery powered light source that is configured to shine light upwards to help illuminate the inflatable flag portion 110 in low light conditions. The light source can also emit light outwards, horizontally. The light source can include a light ring that, from a top view perspective, is circular, and it can surround the vertical shaft 104 at the base of the vertical shaft 104. In operation, the light source can optionally provide a continuous light, or can strobe the light, and finally, it can strobe the light in a distress code pattern (e.g. "S.O.S."). The vertical shaft 104 can be wrapped with a reflective material such as a reflective tape. The balloon 111 of the inflatable flag portion can be very smooth, making a good reflector of light, as well.

Figure 3:
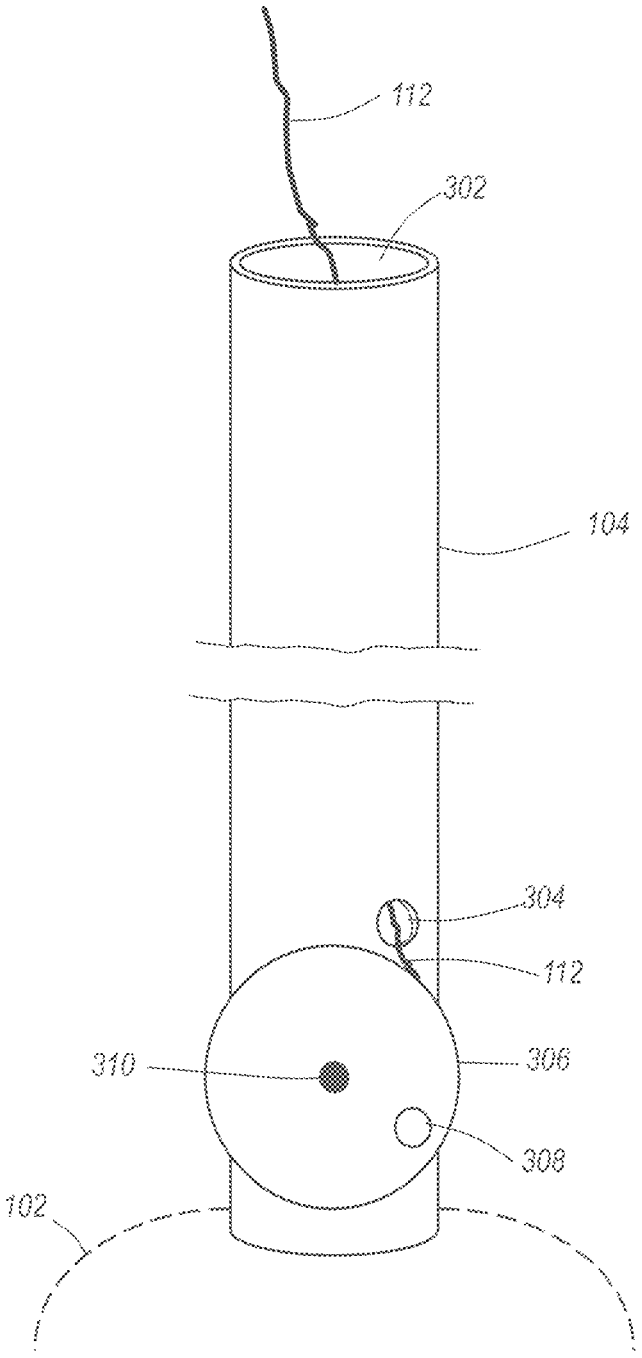
FIG. 3 shows a rotating reel for winding and unwinding a tether line connected to the inflatable flag portion of a diving indication float device, in accordance with some embodiments.
Figure 4:
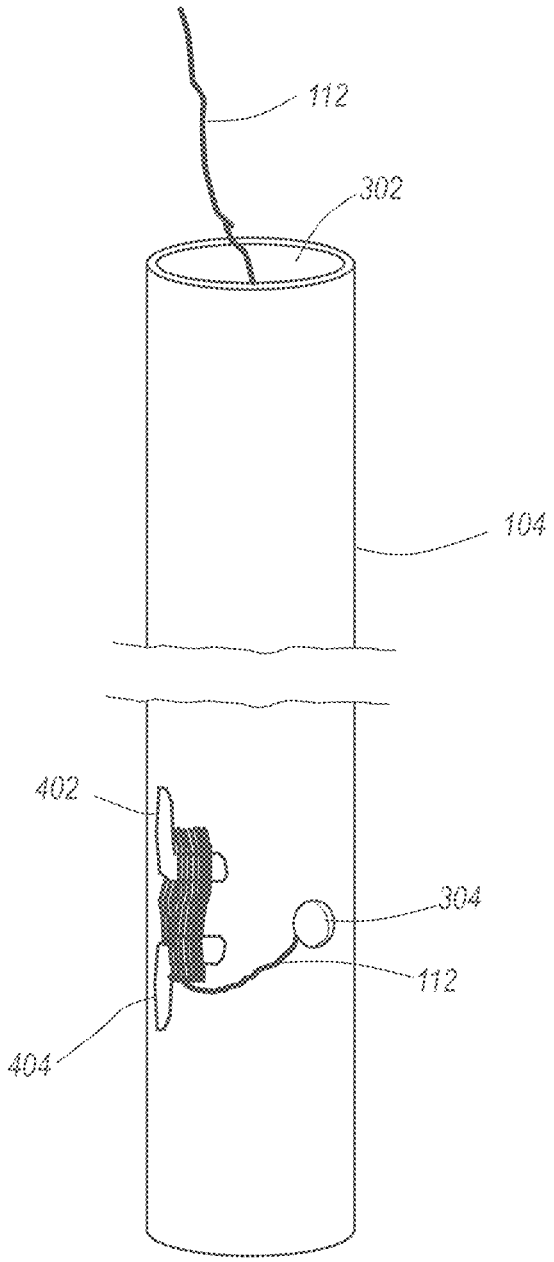
FIG. 4 shows a static reel for winding and unwinding a tether line connected to the inflatable flag portion of a diving indication float device, in accordance with some embodiments.

FIG. 3 shows a rotating reel 306 for winding and unwinding a tether line or cord 112 connected to the inflatable flag portion of a diving indication float device, in accordance with some embodiments. The reel can be a spool-type reel that can be turned using a handle 308. The reel body (spool) turns about a central post 310. The cord 112 can pass through an opening 304 in the vertical shaft 104 to travel upward inside the vertical shaft 104 to the inflatable flag portion. The reel 306 an include a ratchet that prevents excess cord 112 from being unspooled once the user has let out the desired amount of cord 112. Likewise, the spool 306 can be used to gather up all of the cord 112 until the inflatable flag portion is mounted at the top of the vertical shaft. FIG. 4 shows another form of a reel that is hand wound, using two opposing horns 402, 404 that are coupled to the vertical shaft 104. Using this type of reel the user can wind and unwind the cord 112 as desired to achieve the desired height of the inflatable flag portions. The reel can also be located at the top of the vertical shaft 104 adjacent the distal end 108, although this can make it more difficult for a person the water to adjust the length of the cord 112.

Figure 5A:
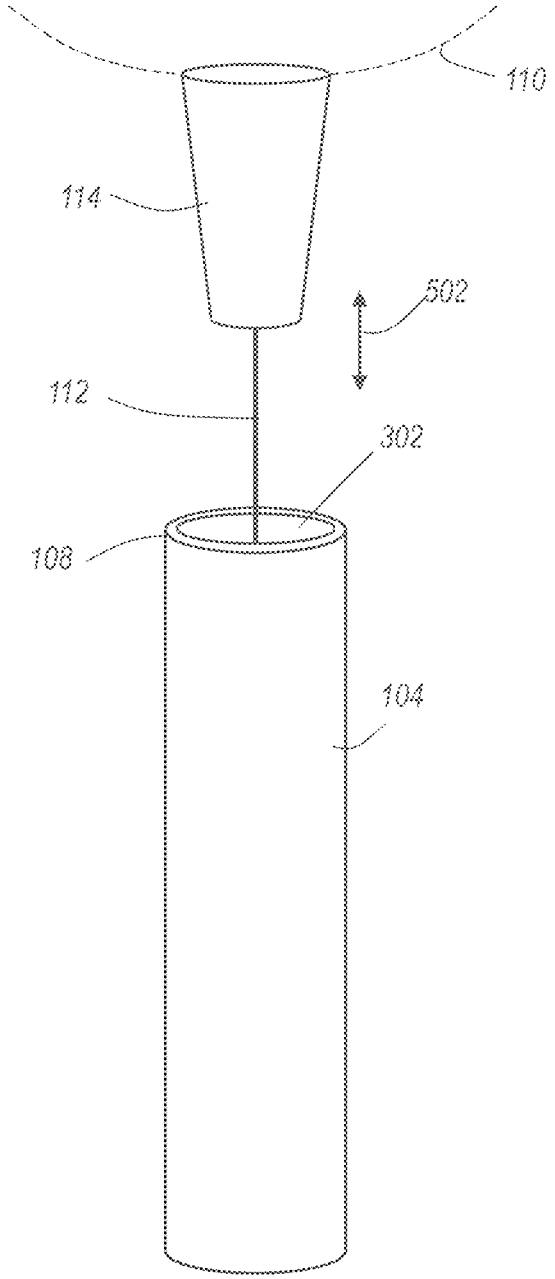
FIG. 5A shows a detail of an inflatable flag portion being raised or lowered, in accordance with some embodiments.
Figure 5B:
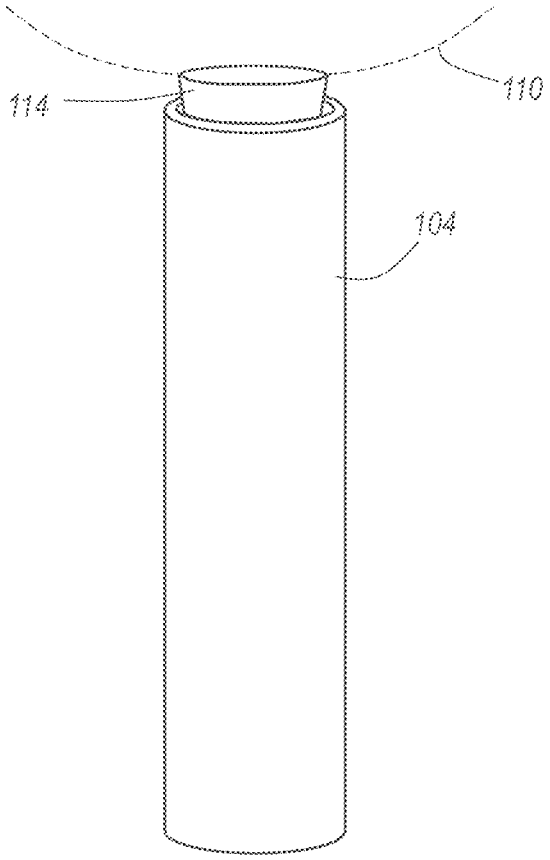
FIG. 5B shows a detail of the inflatable flag portion being reeled into a fully lowered position, in accordance with some embodiments.
Figure 6:
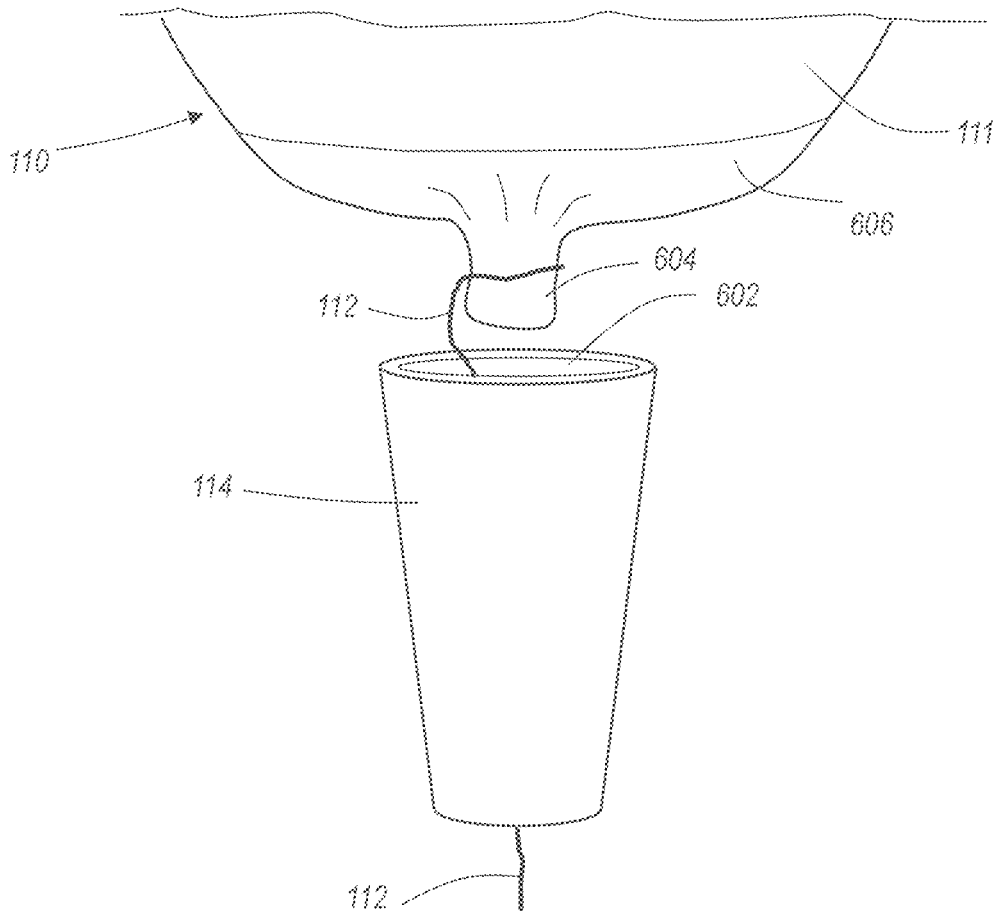
FIG. 6 shows a detail of an inflatable flag portion including a collar for holding an inflatable balloon, in accordance with some embodiments.

FIG. 5A shows a detail of an inflatable flag portion 110 being raised or lowered, in accordance with some embodiments. Here the inflatable flag portion 110 is shown in broken line to focus on the collar 114 and vertical shaft 104. The distal end 108 vertical shaft 104 includes a bore 302 into the vertical shaft 104, or an equivalent structure for receiving the collar 114 therein. From the position shown, if the cord 112 is gathered onto a reel or otherwise shortened, the collar 114 will be pulled into the bore 302 as shown in FIG. 5B. Alternatively, cord can be let out, allowing the inflatable flag portion 110 to rise, as indicated by arrow 502. When there is wind that will prevent FIG. 6 shows a detail of an inflatable flag portion 110 including a collar 114 for holding an inflatable balloon 111, in accordance with some embodiments. The balloon 111 includes a valve stem 604 that can be a flat reed-type valve, as is commonly found on mylar balloon. Alternatively, the stem 604 can be a portion of the balloon in which a knot is tied to trap the gas used to fill the balloon 111 in the balloon 111. The cord 112 can be tied around the stem 604, or otherwise attached to the stem 604 so that the balloon 111 can be pulled into the collar 114 at opening 602, and then the collar 114 can be used as shown in FIGS. 5A-5B. The cord 112 passes through the collar 114 and into the vertical shaft 104, as shown in FIGS. 5A-5B. To minimize damage to the balloon 111, the bottom of the balloon 111 can include a reinforcing layer 606 of material to make the bottom portion of the balloon adjacent to the stem 604 thicker and more resistance to wear and puncture. The cord 112 passes through the collar and then to the vertical shaft.

Figure 7:
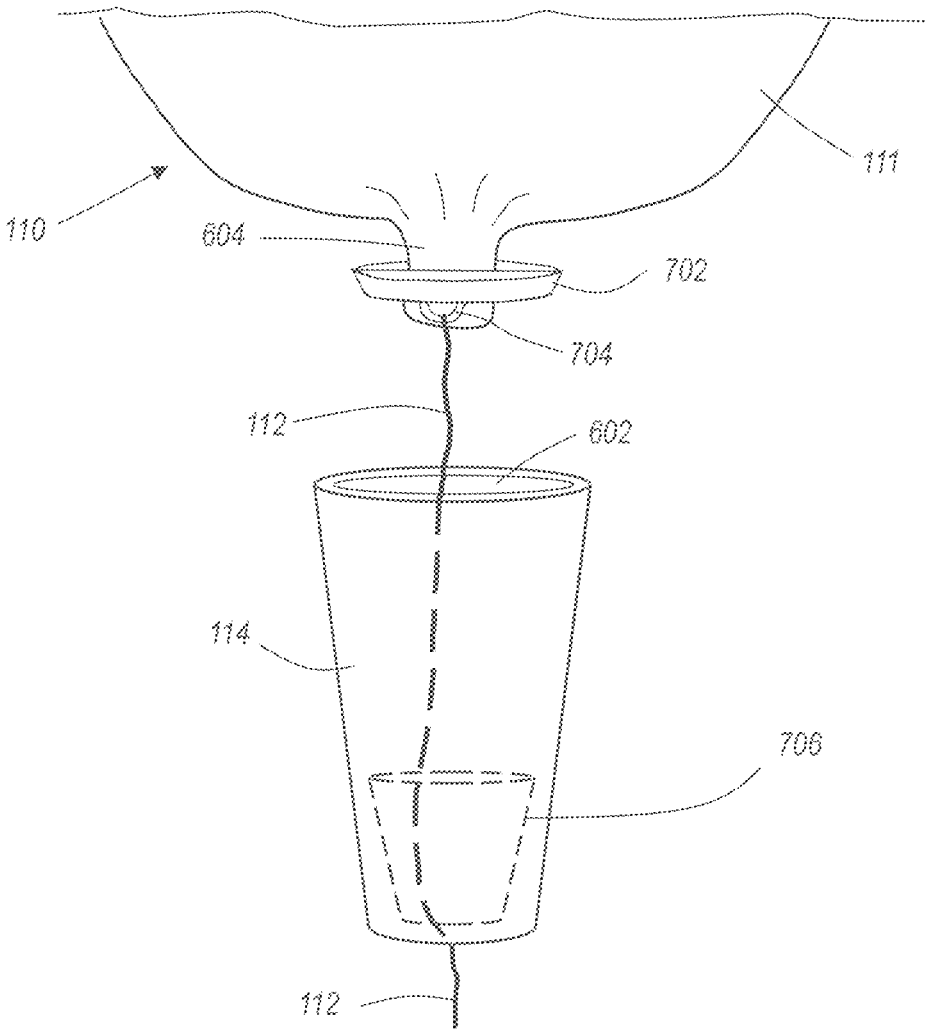
FIG. 7 shows a detail of an inflatable flag portion including a collar for holding an inflatable balloon using a valve clamp plug, in accordance with some embodiments.

FIG. 7 shows a detail of an inflatable flag portion 110 including a collar for holding an inflatable balloon 111 using a valve clamp plug 702, in accordance with some embodiments. The valve clamp plug 702 clamps the step 604 of the balloon 111, and also fits partly into the collar 114. The cord 112 can be connected to a tie point 704 to tether the balloon 111 to the rest of the diving indication float device. The plug 702 allows the stem to pass through the body of the plug 702 where opposing portions of the plug 702 can be moved together to clamp the stem 604. The outside of the plug can be chamfered such that a diameter of the bottom of the plug 702 is smaller than a diameter of the top of the plug, allowing the plug 702 to fit at least partly into the bore 602 of the collar. When the curd 112 is fully gathered on the reel, then the plug 702 will be in engagement with the collar, holding the balloon 111 in place and preventing wind from blowing the balloon 111 downward or otherwise away from the device. A weight 706 can be included in the collar 114 to keep the balloon 111 properly oriented when the inflatable flag portion 110 is elevated bay paying out the cord from the reel.

Figure 9:
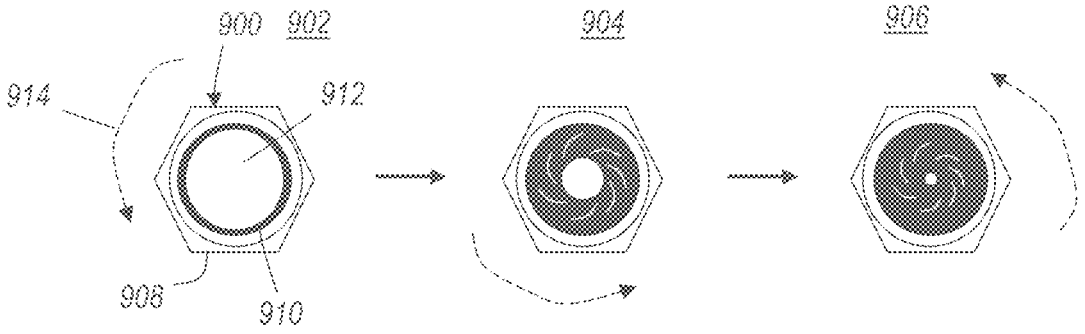
FIG. 9 shows a top view of a compression nut assembly through a progression of closing the opening through the compression nut assembly, for use in holding a balloon or flag rod, in accordance with some embodiments.
Figure 10:
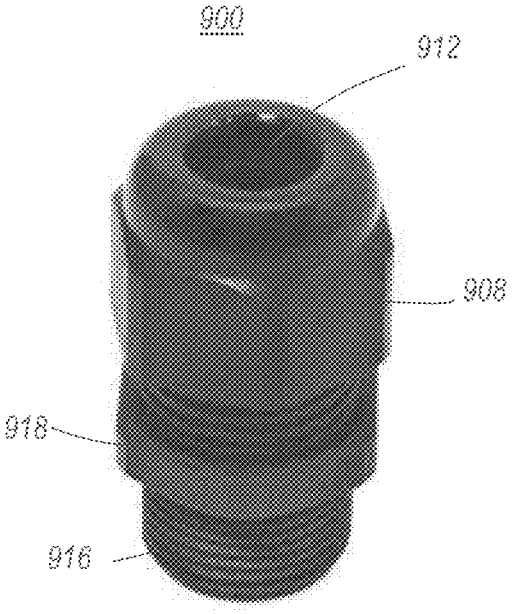
FIG. 10 shows a perspective view of a compression nut assembly adapted to fit into the distal end of a vertical shaft of a diving indication float device, in accordance with some embodiments.
Figure 11:
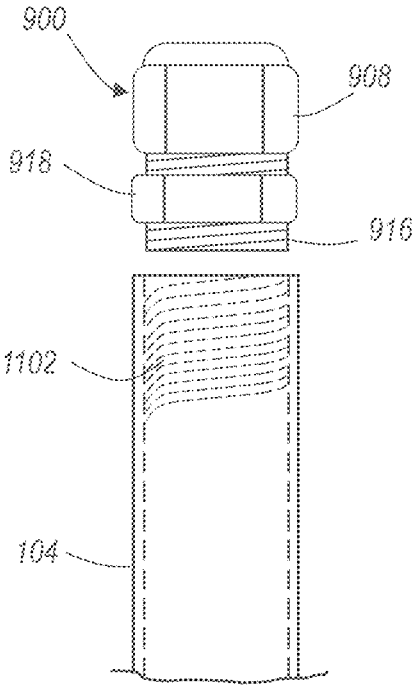
FIG. 11 shows a distal end of a vertical shaft of a diving indication float device in which a compression nut assembly can be coupled to hold a balloon or flag rod, in accordance with some embodiments.

FIG. 9 shows a top view of a compression nut assembly 900 through a progression of closing the opening through the compression nut assembly, for use in holding a balloon or flag rod, in accordance with some embodiments. Referring to FIGS. 9 and 10 jointly, the compression nut assembly 900 includes a threaded cylindrical body 916. In one end of the body 916 is a resilient cylindrical member 910 that extends outward from the cylindrical body 916 at the top end of the cylindrical body 916. There is a bore through the member 910 and the member 910 can be relieved with cuts to allow the member 910 to be compressed inward, narrowing the bore. A domed nut 908 is threaded onto the top end of the body 916, and provides inward compression of the member 910 as the domed nut 908 is turned/tightened on the body 916. The compression nut assembly 900 in general operates very similarly, if not identically, to what is known in the cabling industry as a cable gland. In state 902 the domed nut 908 has not begun to compress the member 910, and the bore 912 is at its maximum size. In state 904 the domed nut 908 has been tightened by turning the domed nut 908 on the body 916, thereby creating an inward force on the top of the member 910, resulting in the bore 912 being substantially smaller. In state 906 the domed nut 908 can be tightened as much as possible, resulting in a minimal size bore through the member 910. Being a resilient material, like rubber, the member seals around anything disposed in the bore 912 when sufficiently compressed by the domed nut 908. In FIG. 11, the upper distal end of the vertical shaft 104 can be seen, with threads 1102 on the inside of the vertical shaft 104 which mate with the threads on the body 916 of the compression nut assembly 900. Once the body 916 is sufficiently threaded into the distal end of the vertical shaft 104, the locking nut 918 can be tightened against the top end of the vertical shaft 104 to hold the compression nut assembly 900 in place so that the domed nut 908 can be adjusted as needed, including being removed completely so that the compliant member 910 can also be removed.

Figure 12:
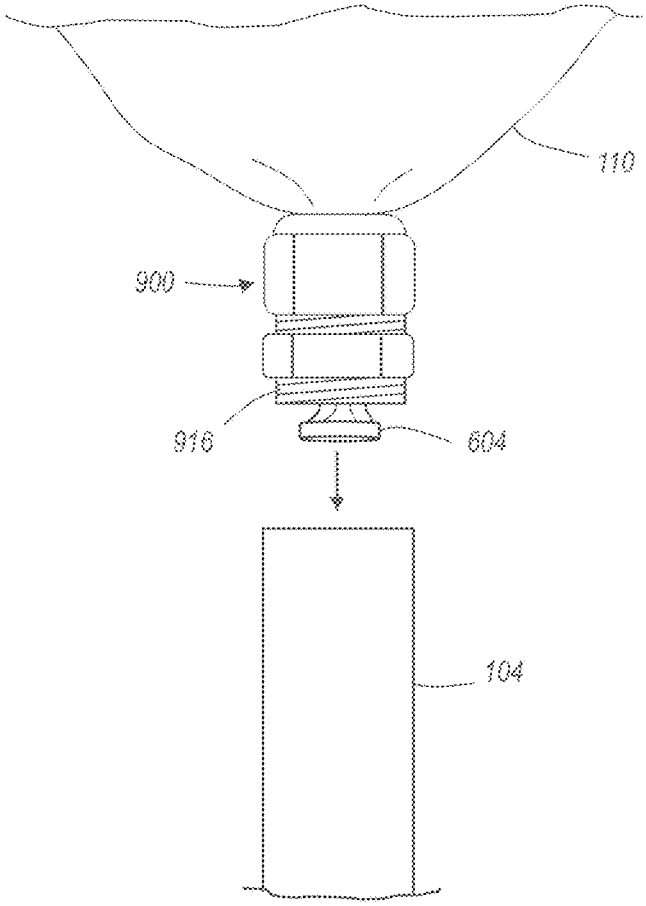
FIG. 12 shows a compression nut assembly holding an inflated balloon that is sealed by a compression nut assembly being inserted into the distal end of a vertical shaft of a diving indication float device.
Figure 13:
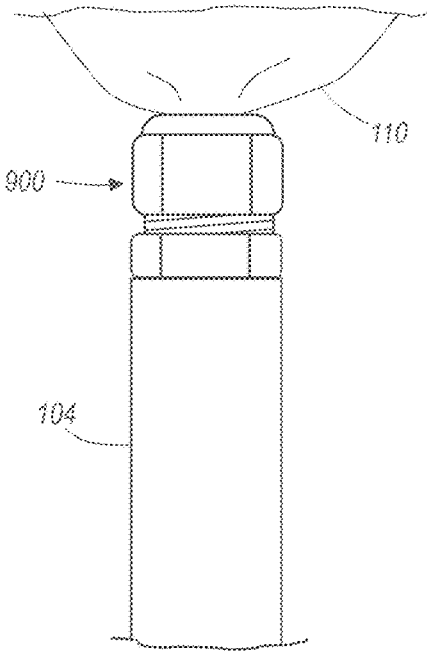
FIG. 13 shows a compression nut assembly holding an inflated balloon that is sealed by a compression nut assembly coupled to the distal end of a vertical shaft of a diving indication float device.

FIG. 12 shows a compression nut assembly 900 holding an inflated balloon 110 that is sealed by the compression nut assembly 900 being inserted into the distal end of a vertical shaft 104 of a diving indication float device. As shown in FIG. 12, the compression nut assembly 900 can be taken apart, and the compliant member 910 removed. When so removed, the compliant member 910 is not under compression and the bore 912 is at its maximum diameter. The stem or nozzle 604 of the balloon 110 can be fed through the bore of the domed nut, and then through the bore 912 of the compliant member 910. With the stem 604 through compliant member 910 and domed nut 908, the compliant member 910 can then be inserted into the threaded cylindrical body 916 and the domed nut threaded loosely onto the body 916. Then the balloon 110 can be filled (e.g. with helium), and once the balloon is filled, the domed nut 908 can be tightened to close and seal the balloon 110. Then the compression nut assembly 900 can be threaded into the vertical shaft 104, as in FIG. 13. In some embodiments the filled balloon can remain coupled to the top of the vertical shaft 104 via the compression nut assembly 900. In some embodiments, the compression nut assembly 900 and/or the balloon stem 604 can be coupled to a cord or line (e.g. 112) to allow the balloon to float upwards from the vertical shaft 104 as previously described.

Figure 14:
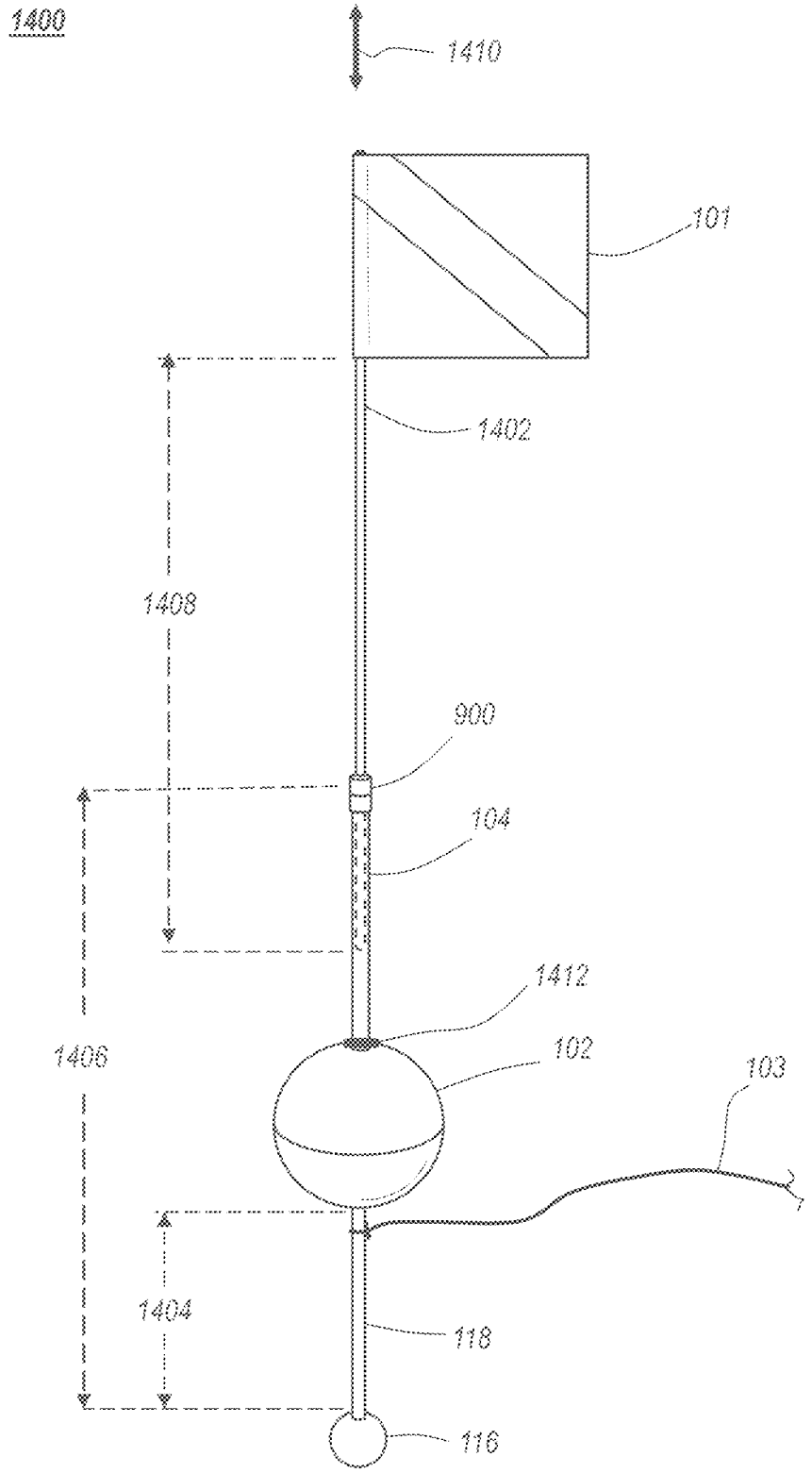
FIG. 14 shows a diving float device having an extendible flag rod in a telescoping arrangement with the vertical shaft of a diving float device, in accordance with some embodiments.

FIG. 14 shows a diving float device 1400 having an extendible flag rod 1402 in a telescoping arrangement with the vertical shaft 104 of the diving float device 1400, in accordance with some embodiments. In device 1400, a flag rod 1402 is held in place by the compression nut assembly 900 at the upper distal end of the vertical shaft 104. By loosening the domed nut of the compression nut assembly 900, the flag rod 1402 can be moved up or down in the vertical shaft 104, as indicated by arrow 1410 and as long as a portion of the flag rod remains inside the vertical shaft 104, the flag rod can be held in place. This allows the flag 101, which is attached to the upper end of the flag rod 1402, to reach much higher than the top of the vertical shaft 104, but also allowing collapse of the system for easier travel with the diving indication device 1400. The flag rod 1402 can have a length 1408 from the bottom of the flag rod 1402 to the flag 110 that is as long as the length 1406 of the vertical shaft 104, or longer or shorter in some embodiments. The length 1404 of the lower portion 118 of the vertical shaft 104, relative to the buoyant body 102, can be adjusted by moving a rubber ring 1412 on the vertical shaft 104. For calm conditions the length 1404 can be shorter to elevate the flag 101 higher. Where there are significant waves, then a longer length 1404 is desirable to reduce the amount of pitching of the vertical shaft 104. Ordinarily this would mean a shorter position of the flag 101, but since the flag rod 1402 can be extended, the flag 101 can still be raised to a suitable height. In some embodiments the vertical shaft 104 can have a total length 1406 of about four feet, and the flag rod 1402 can have a length 1408 of at least four feet, with additional length on which to mount the flag 101. The flag rod 1402 can be made of wood, metal tubing, a polymeric material, fiberglass, or any other lightweight, marine suitable material. The diving indication device 1400, although shown here using a flag rod 1402 and flag 101, can likewise accommodate a balloon as previously described, and it can include any other features previously described.

Figure 15:
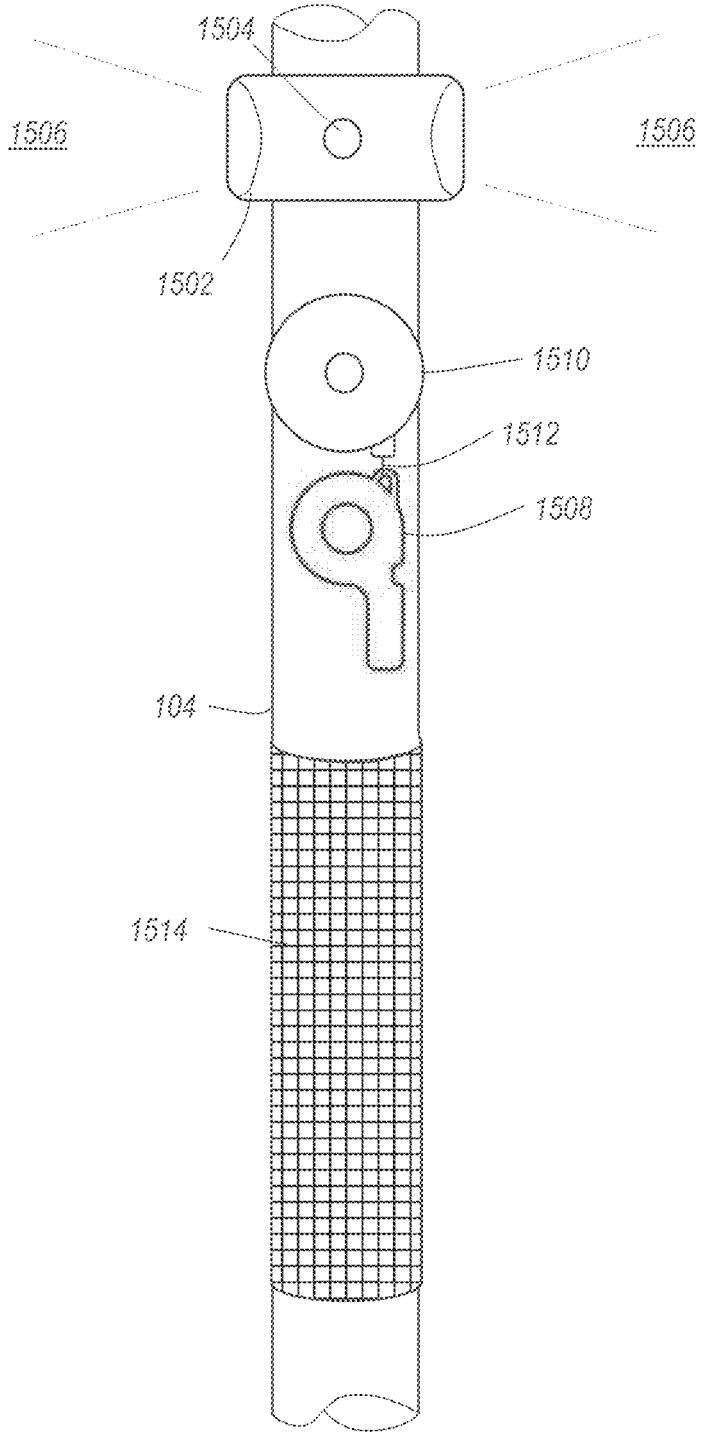
FIG. 15 shows a portion of a diving float device including reflective tape, a light, and a whistle on a reel, in accordance with some embodiments.

FIG. 15 shows a portion of a diving float device including reflective tape 1514, a light source 1502, and a whistle 1508 on a reel 1510, in accordance with some embodiments. These accessories can be mounted on the vertical shaft 104, above the buoyant body 102. The light source 1502 can include and on/off button 1504 to control operation of the light source 1502. The button can be pressed once to turn on the light source 1502 so that the light 1502 source will emit light 1506. The light 1506 can be continuous or strobed, and it can be different colors (e.g. white light or red light, or both). The light source 1502 can be mounted using, for example, a cable clamp type device or any other suitable mounting structure. The reflective tape 1514 is a tape having an adhesive on one side and a light-reflecting material on the other (outward-facing) side, and can cover a portion of, or the entire vertical shaft 104. A whistle 1508 can be used to get the attention of someone else in the vicinity of the diver using the diving indication device. To ensure that the whistle is not lost, it can be mounted on cord 1512 which is gathered on a spring driven reel 1510. A person can pull on the whistle 1508 and the reel will pay out line so that the person can blow the whistle 1508, and the reel keeps the whistle from getting lost.

Figure 16:
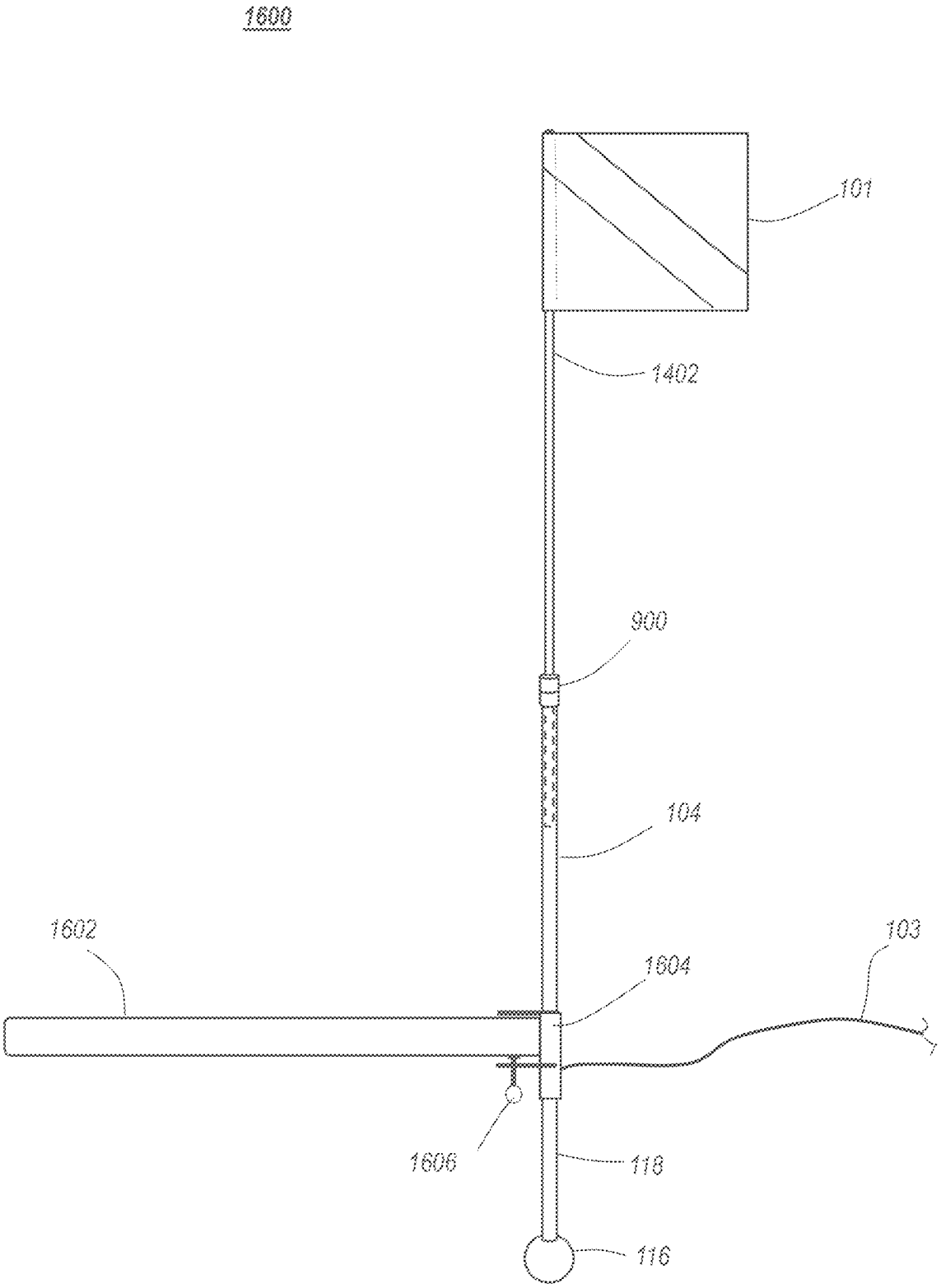
FIG. 16 shows a diving indication device including a clamp that allows the diving indication device to be clamped to another object or structure, in accordance with some embodiments.

FIG. 16 shows a diving indication device 1600 including a clamp 1604 that allows the diving indication device to be clamped to another object or structure, in accordance with some embodiments. The clamp 1604 can be attached to the vertical shaft 104 in a rigid or sufficiently rigid manner. The clamp 1604 can include opposing jaw members and a tensioner 1606 to open or close those jaw members, relative to each other. The clamp 1604 can be used to attach the diving indication device to some other structure 1602, which can be, for example, a paddle board, a boat roof, or any other structure. Attaching the diving indication device 1600 to some floating structure, such as a paddle board, allows the diver or divers to use the structure for other purposes beside simply floating the diving indication device. For example, a person can lay on a paddle board to be out of the water. This can be used simply to take a break from being in the water, as a form of transportation to and from a diving location, or even in an emergency to carry someone across the water to safety and emergency services, if needed. The diving indication device 1600 can also be clamped to structure of a boat used by divers to get to a diving location. By clamping the diving indication device to an upper structural element of the boat, the diving indication device will be more easily seen by other boaters, who will then know to keep away from the area for the safety of the divers.

A diving indication flotation device has been disclosed that allows divers, snorkeler, and other people in the water to better ensure that others will see that there are people in the water, as indicated by the well known "diver down" pattern on either a flag, a balloon, or both. The diving indication floatation device includes a buoyant body that floats at the surface of the water. A vertical shaft passes through the buoyant body, or uses a clamp to clamp the vertical shaft to another structure, and at a lower end of the vertical shaft, below the buoyant body, there can be a weight that keeps the vertical shaft upright when it is floated in the water. In other embodiments, such as when the vertical shaft is clamped to another structure, the weight is not needed. The vertical shaft can be hollow, and allow for the attachment of a balloon, a flag, a flag rod, or some combination of these. In calm wind conditions, a balloon tethered to a cord or line can be used to ensure boat operators see the diving symbol (on the balloon) and know to keep away from the area. In other conditions, when a balloon isn't practical, or at least tethering a ballon isn't practical, a flag can be used, either attached to the vertical shaft, or to a flag rod that telescopes into and out of the vertical shaft. The balloon can also be reeled in and held tightly at the top of the vertical shaft if wind conditions make freely tethering the balloon impractical. The diving indication device can also include accessories, such as a light source, a whistle, and it can include reflective tape on the vertical shaft.

The claims appended hereto are meant to cover all modifications and changes within the scope and spirit of the present invention.

What is claimed is:

1. A kit for a diving indication float device, comprising:

a buoyant body configured to float on a surface of a body of water;

a vertical shaft configured to extend upwards from the buoyant body to a distal end;

an inflatable flag portion comprising a balloon that, when inflated, has a minimum cross dimension of at least twelve inches and displays a diver down symbol;

a cord configured to attach to the inflatable flag portion and extendable along the vertical shaft to adjust a height of the inflatable flag portion relative to the distal end of the vertical shaft;

an extendible flag rod configured for telescoping arrangement with the vertical shaft;

a two-dimensional flag configured to attach to an upper end of the extendible flag rod; and a securing mechanism configured to mount at the distal end of the vertical shaft to selectively hold either the inflatable flag portion or the extendible flag rod, the securing mechanism including a compression nut assembly comprising a threaded cylindrical body, a resilient cylindrical member with a bore, and a domed nut configured to compress the resilient cylindrical member to narrow the bore.

2. The kit of claim 1, wherein the compression nut assembly is configured to seal around a stem of the balloon when holding the inflatable flag portion.

3. The kit of claim 1, wherein the balloon is configured to be filled with a gas lighter than air, and the diver down symbol comprises a red background with a diagonal white stripe that encircles the balloon.

4. The kit of claim 1, further comprising a reel configured to mount on the vertical shaft or the buoyant body, the reel arranged to wind and unwind the cord.

5. The kit of claim 1, further comprising:

a buoyant body that is configured to be adjustably disposed on the vertical shaft; and clamp that is configured to be attached to the vertical shaft to clamp the vertical shaft to another structure.

6. A diving indication float device, comprising:

a buoyant body configured to float on a surface of a body of water;

a vertical shaft extending upwards from the buoyant body to a distal end;

a compression nut assembly mounted at the distal end of the vertical shaft, the compression nut assembly comprising a threaded cylindrical body, a resilient cylindrical member with a bore, and a domed nut configured to compress the resilient cylindrical member to narrow the bore; and a balloon secured to the distal end of the vertical shaft by the compression nut assembly, wherein the balloon, when inflated, is also sealed by the compression nut assembly.

7. The diving indication float device of claim 6, wherein the balloon has a minimum cross dimension of at least twelve inches and includes diver down symbol on an outside surface thereof.

8. The diving indication float device of claim 6, further including a weight at a bottom of the buoyant body, opposite the vertical shaft.

* * * * *